US005355794A

United States Patent [19]

Freudenheim

[11] Patent Number: 5,355,794

[45] Date of Patent: Oct. 18, 1994

[54] PROCESS AND APPARATUS FOR DRY PRINTING

[76] Inventor: Herbert Freudenheim, 45 Brook Court, Watling Street, Radlett, Herts. WD7 7JA, Great Britain

[21] Appl. No.: 971,769

[22] PCT Filed: Aug. 17, 1990

[86] PCT No.: PCT/EP91/01566

§ 371 Date: Feb. 12, 1993

§ 102(e) Date: Feb. 12, 1993

[87] PCT Pub. No.: WO92/03295

PCT Pub. Date: Mar. 5, 1992

[30] Foreign Application Priority Data

Aug. 17, 1990 [GB] United Kingdom ..... 9018107

[51] Int. Cl.[5] ..... B41M 1/12

[52] U.S. Cl. ..... 101/129; 118/654; 118/656; 427/468

[58] Field of Search ..... 101/129; 428/403; 427/468; 118/301, 654, 656, 657, 255, 256, 258, 261

[56] References Cited

U.S. PATENT DOCUMENTS

| | | | |
|---|---|---|---|
| 2,966,429 | 12/1960 | Darrell . | |
| 3,081,698 | 3/1963 | Childress et al. | 427/468 |
| 3,202,092 | 8/1965 | Childress . | |
| 3,245,341 | 4/1966 | Childress et al. | 427/468 |
| 3,273,496 | 9/1966 | Melmon | 118/654 |
| 3,283,703 | 11/1966 | Childress et al. | 118/656 |
| 3,285,167 | 11/1966 | Childress . | |
| 3,382,796 | 5/1968 | Javorik et al. | 118/654 |
| 3,460,468 | 8/1969 | Johnson | 427/468 |
| 3,504,624 | 4/1970 | Kennedy, Jr. | 101/129 |
| 3,505,951 | 4/1970 | Gartrell | 101/129 |
| 3,561,356 | 2/1971 | Rarey et al. | 101/129 |
| 3,665,851 | 5/1972 | Edwards et al. | 101/129 |
| 3,665,856 | 5/1972 | Heller, Jr. | 101/129 |
| 3,776,630 | 12/1973 | Ohno et al. | 101/129 |
| 3,828,670 | 8/1974 | Kennedy | 101/129 |
| 4,096,826 | 6/1978 | Stange | 118/656 |
| 4,675,216 | 6/1987 | DuForest et al. | 118/301 |
| 4,752,528 | 6/1988 | Oka | 428/403 |
| 4,791,882 | 12/1988 | Enoguchi et al. | 118/257 |
| 5,065,192 | 11/1991 | Adkins et al. | 118/657 |
| 5,095,339 | 3/1992 | Terashima | 118/656 |

FOREIGN PATENT DOCUMENTS

| | | |
|---|---|---|
| 0197242 | 1/1986 | European Pat. Off. . |
| 1091141 | 10/1989 | Japan . |

*Primary Examiner*—Eugene H. Eickholt
*Attorney, Agent, or Firm*—Fred Philpitt

[57] ABSTRACT

Apparatus and method are disclosed for carrying a dry printing process comprising a bed ( 18; 56; 64; 124; 156) for a printing substrate (20; 54; 122) that is to be printed; a screen printing stencil mounted above the printing substrate and in direct contact therewith, at least one brush (32; 46; 74, 76) with flexible fibers and structure for dusting each brush with a printing powder containing a dielectric plastics binder and pigments; a motor for moving each brush over the stencil and the printing substrate and comprising a field generator (16, 26, 34, 36; 48, 52, 56; 84, 124, 138; 72, 124, 138) which generates an electric field in the vicinity of the portion of the printing substrate (20; 54; 122) lying opposite each brush, the field lines of which extend substantially perpendicular to the surface of the printing substrate; and structure for fixing the printing powder on the printing substrate; the field generator being capable of generating a field of at least 100 V/cm in the vicinity of the portion of the printing substrate that is opposite at least one brush; structure (18; 118, 120) for moving each brush and maintaining a small working distance between the outer surfaces of each brush and the printing substrate; and at least one brush being arranged in a box (30; 72) which is open towards the stencil and the printing substrate and cooperating with the stencil and the printing substrate in a substantially sealed manner.

35 Claims, 6 Drawing Sheets

PROCESS AND APPARATUS FOR DRY PRINTING

Figure 1:
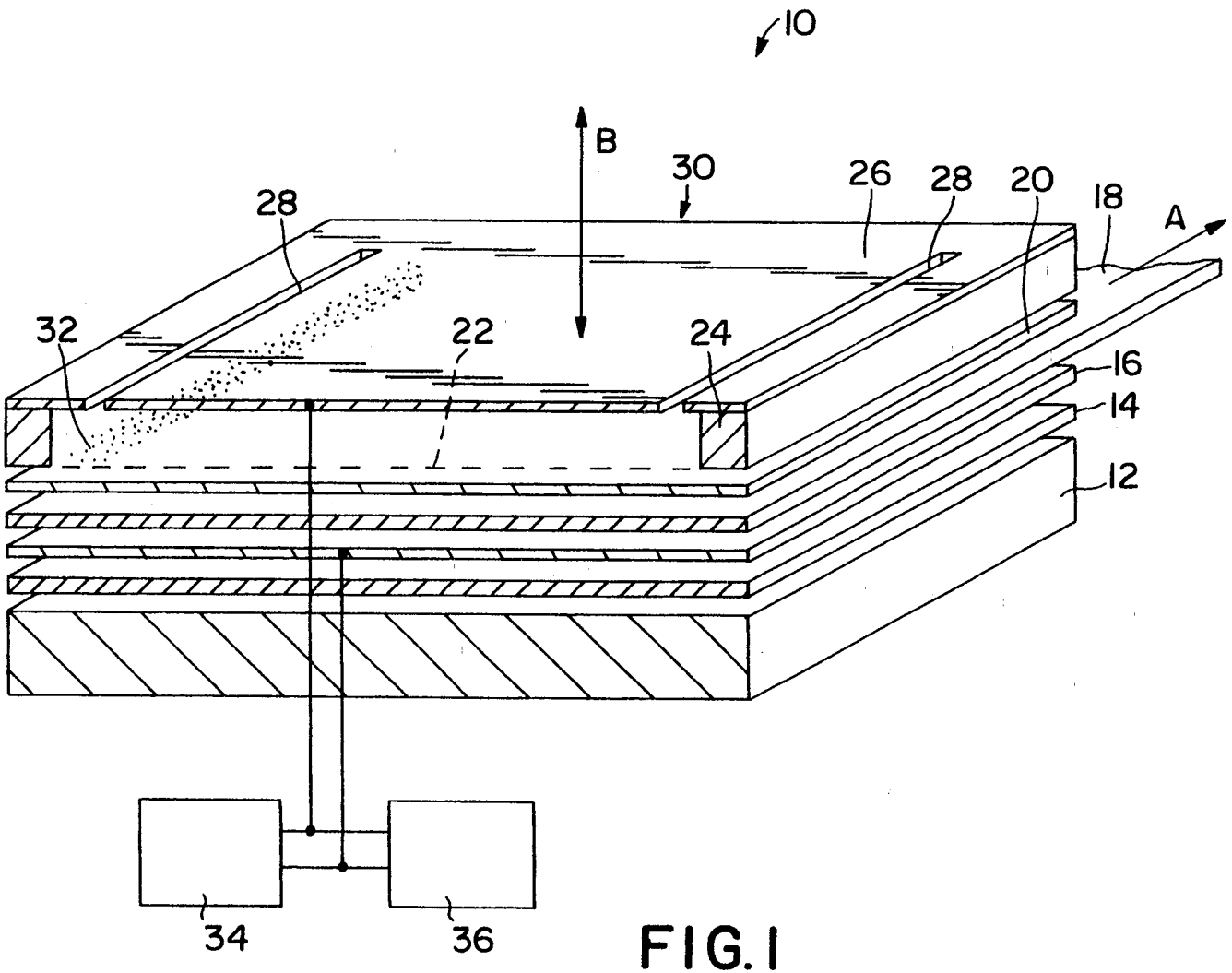

The present invention relates to a process for the dry printing of printing substrates, especially in screen printing and tampon printing, and to an apparatus for its use. The invention further relates to a process for the manufacture of printing powder for use in such a process and such an apparatus.

In the dry screen printing process, printing powder is moved through a screen printing stencil having the desired pattern in its fine-meshed stencil material. The printing powder reaches the printing substrate to be printed via the screen printing stencil.

A dry screen printing process is known from U.S. Pat. No. 3,285,167 in which printing powder particles are pressed through a screen printing stencil using a brush having flexible mechanical fibres. The screen printing stencil is located above and spaced from the printing substrate to be printed. An electrode arranged beneath the latter and the screen made of electrically conductive material are connected to the terminals of a high voltage source and in this manner an electrostatic field the field lines of which are substantially perpendicular to the plane of the printing substrate is produced at the location of the printing substrate. By means of that field the printing powder particles having dielectric material are moved towards the printing substrate once they have been pressed through the meshes* of the screen printing stencil by the fibres of the brush. Rotating brushes are also proposed as brushes. The application of the printing powder from a reservoir is carried out using transfer rollers which dip into the reservoir.

A similar dry screen printing process and an apparatus that can be used for it are described in U.S. Pat. No. 3,202,092. That specification also proceeds on the assumption that movement of the printing powder particles takes place in two phases: a mechanical pressing of the printing powder particles through the meshes of the screen printing stencil using a brush and subsequently movement of the dielectric printing powder particles in an electrostatic field, a space again being maintained between the screen printing stencil and the printing substrate.

The procedure according to U.S. Pat. No. 3,285,167 and U.S. Pat. No. 3,202,092 is satisfactory so long as large areas of the printing substrate are printed with the same colour. It has been found, however, that when printing small details and especially in the case of half-tone screen printing the colour reproduction is not entirely satisfactory.

EP-A-197 242 describes special toner particles and the manufacture thereof. These consist of a basic body of synthetic resin having an average particle diameter of from 0.1 to 1000 μm and modifier particles adsorbed onto those basic bodies. The modifier particles consist, for example, of a material having an anionic or cationic group. In this manner it is possible to make the surface properties and optical properties of the composite particles different from the corresponding properties of the basic bodies. The diameter of the modifier particles is 1/5 to 1/20 of the diameter of the basic bodies.

The invention provides a dry printing process in which a screen printing stencil is arranged over the printing substrate that is to be printed. Printing powder is then distributed over the screen printing stencil, an electrostatic voltage difference being applied between the powder and the printing substrate. This assists in attracting the printing powder towards the substrate. In this manner, an image of the pattern of the screen printing stencil is obtained on the printing substrate.

It is not necessary to maintain a significant air gap between the screen printing stencil and the printing substrate if a voltage difference is applied between the printing powder and the printing substrate. Preferably, according to the invention it is even preferred to work with the screen printing stencil and the printing substrate almost in contact or in very intimate contact with each other. Images are thus obtained with good resolution since it is thus possible to minimise spreading of the printing powder on its way between the screen printing stencil and the printing substrate. In the preferred printing process according to the invention, such behaviour of the printing powder is almost completely suppressed.

The screen printing stencil preferably consists of electrically conductive material, for example metal or metallised fabric.

If the printing substrates consist of a dielectric material such as paper, plastics or glass, as is usually the case, they can be electrostatically charged. This can be effected, for example, by a corona discharge unit or by a chargeable metallic (for example aluminium) electrode connected to a d.c. high-voltage supply unit and arranged on the side opposite the screen printing stencil. If the printing substrate is electrically conductive (for example a metal foil) it can be earthed or charged by connection to a d.c. high-voltage supply.

The printing powder may be a printing powder of the kind conventionally used in electrophotographic printing. The printing powder can be used together with carrier particles the dimensions of which are sufficiently large for them to be unable to pass through the meshes of the screen printing stencil. The printing powder may be a mixture of two or more particle types. The printing powder is electrically charged by frictional electricity, for example by brushing or cascading over the screen printing stencil. The printing powder may additionally be charged from an external high-voltage supply, for example on its way through the screen printing stencil, for example by a corona discharge. The screen may accumulate small amounts of charge due to the brushing, due to the dancing movement of the printing powder over its surface or even from the printing substrate; in some cases it is also possible to apply high voltage directly to the screen. The brushing and cascading also promotes the distribution of the printing powder over the screen and hence over the image. The initially obtained printing powder image can be fixed, for example by applying heat if the printing powder melts under the action of heat. In a preferred embodiment of the invention, the printing powder is distributed over the screen magnetically or at least with magnetic assistance; this may form a substitute for the brushing and cascading. For this purpose, a printing powder can be used in combination with larger ferromagnetic carrier beads; a ferromagnetic component can also be incorporated into the printing powder itself, for example an admixture of ferromagnetic particles. Distribution of the printing powder over the screen is effected by moving one or more permanent magnets and/or electromagnets over the screen, preferably by the primary winding or the stator of a linear motor. In this manner, a magnetic field is obtained which moves across the screen and distributes the printing powder accordingly. The ferromagnetic material used may be a ferrite material or an iron material.

One advantage obtained by magnetically moving and distributing the printing powder over the screen is that there are no moving operating elements that have to be moved over the printing powder supply surface of the screen. It is therefore possible to use a powder box the base of which is formed by the screen and that is sealed apart from its base and has only relatively small openings through which new printing powder can be supplied. This minimises both the loss of printing powder and the soiling by substances in the atmosphere. The printing powder supply lines to the re-fill openings are preferably sealed around the filling openings.

The magnetic distribution of the printing powder also obviates the need for a normal purely mechanical brush or the like. This minimises any deformation of the screen, the wear of the screen and also the generation of frictional heat in the printing powder.

If the primary part of a linear motor is used to distribute the printing powder over the screen, then the construction thereof, the voltage applied and the distance from the screen will preferably be so selected that the optimum smooth movement and distribution of the printing powder over the screen is obtained.

In cases where the printing powder is ferromagnetic, the supply of printing substrates on which images are to be produced will preferably consist of a non-magnetic or only weakly magnetic material.

If a magnetic field is used to move and distribute the printing powder over a flat screen, the movement of the printing powder may be perpendicular or parallel to the direction in which the printing substrate is moved relative to the screen in the machine feed direction.

In a further preferred embodiment of the invention, the printing substrate which is to be provided with an image through the screen printing stencil is not electrically charged before it is brought into juxtaposition with the screen; only when it has reached the working position relative to the screen required for printing is charging carried out. Analogously, the printing substrate is not discharged until separation of the screen and printing substrate has been completed after the image has been produced. This distinctly reduces smearing of the resulting printed image which would otherwise be obtained as a result of the printing powder being deposited prematurely or the printing powder moving while a relative movement is being carried out between screen and printing substrate. Discharging of the printing substrate is preferably carried out actively (for example by applying an a.c. high voltage of, for example, about 5 kV) and not simply by earthing. If the screen and the printing substrate are in contact to produce the image, as is preferred, the charging and discharging can be carried out either at the screen or at the printing substrate or at the screen and the printing substrate. Preferably, the powder supply side of the screen is sealed by a box which covers it, and re-filling of the printing powder into the space above the screen is carried out through relatively small opening or slots as already discussed. In cases where the printing substrate is not charged until it has reached the working position relative to the screen desired for printing, this charging is preferably effected using an electrode (for example an aluminium electrode) which is arranged on the opposite side of the printing substrate, remote from the screen.

The two above-mentioned preferred ways of carrying out the process according to the invention (magnetic distribution of the printing powder over the screen and applying a voltage between printing powder and printing substrate only when screen and printing substrate lie opposite each other) preferably take place together. Where magnetic forces are used to distribute the printing powder over the surface of the screen it may be either the screen and/or the magnetic field that is moved. Thus, either a flat screen and a printing substrate can be brought into temporary, stationary juxtaposition in order to produce the printed image, the printing powder then being moved magnetically over the stationary plane screen, or the printing substrate can be brought into a position opposite a revolving screen containing the printing powder, a stationary magnetic field then being used to assist gravity in keeping the printing powder at the bottom of the revolving screen where screen and printing substrate meet to produce the printed image.

Figure 2:
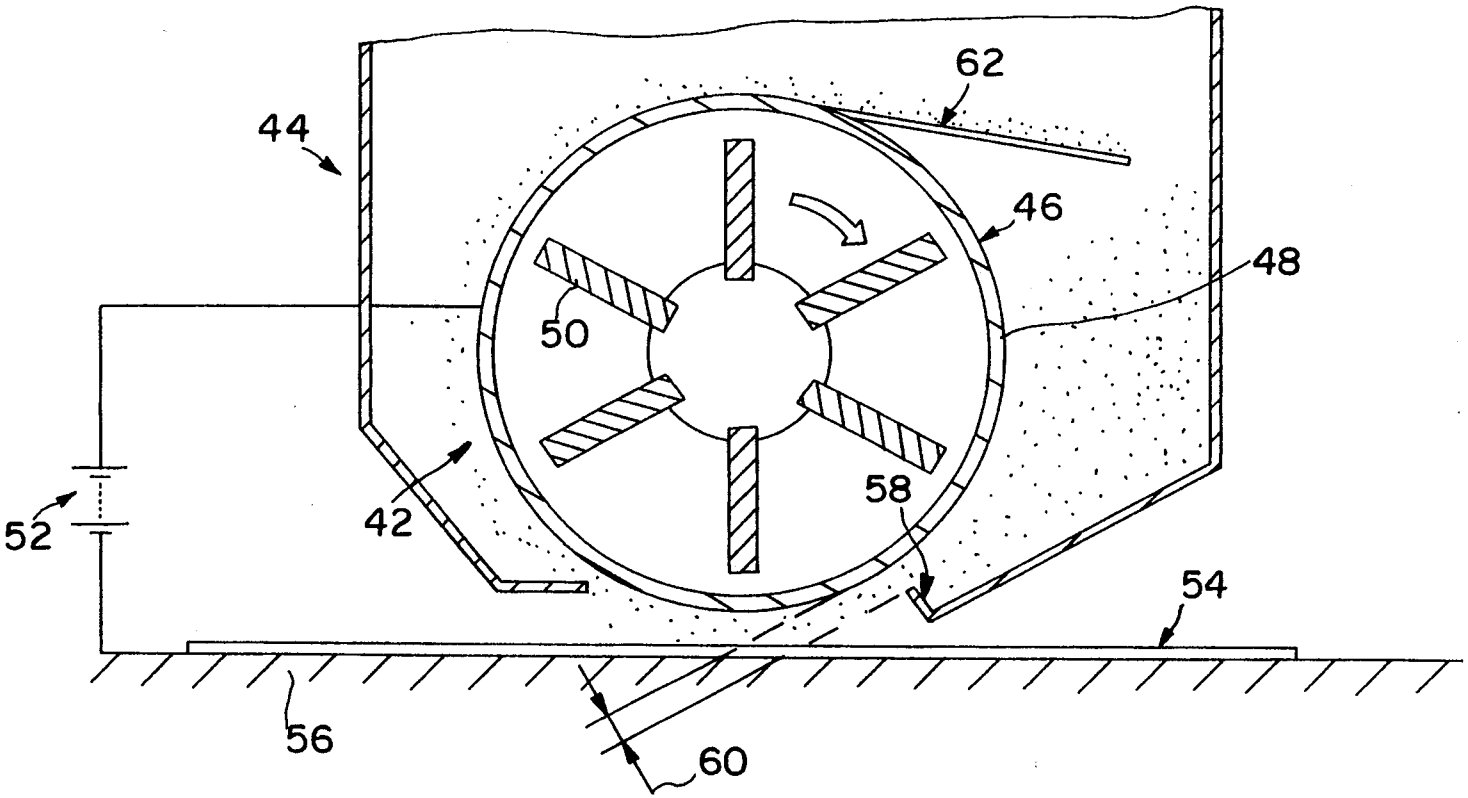
Figure 3:
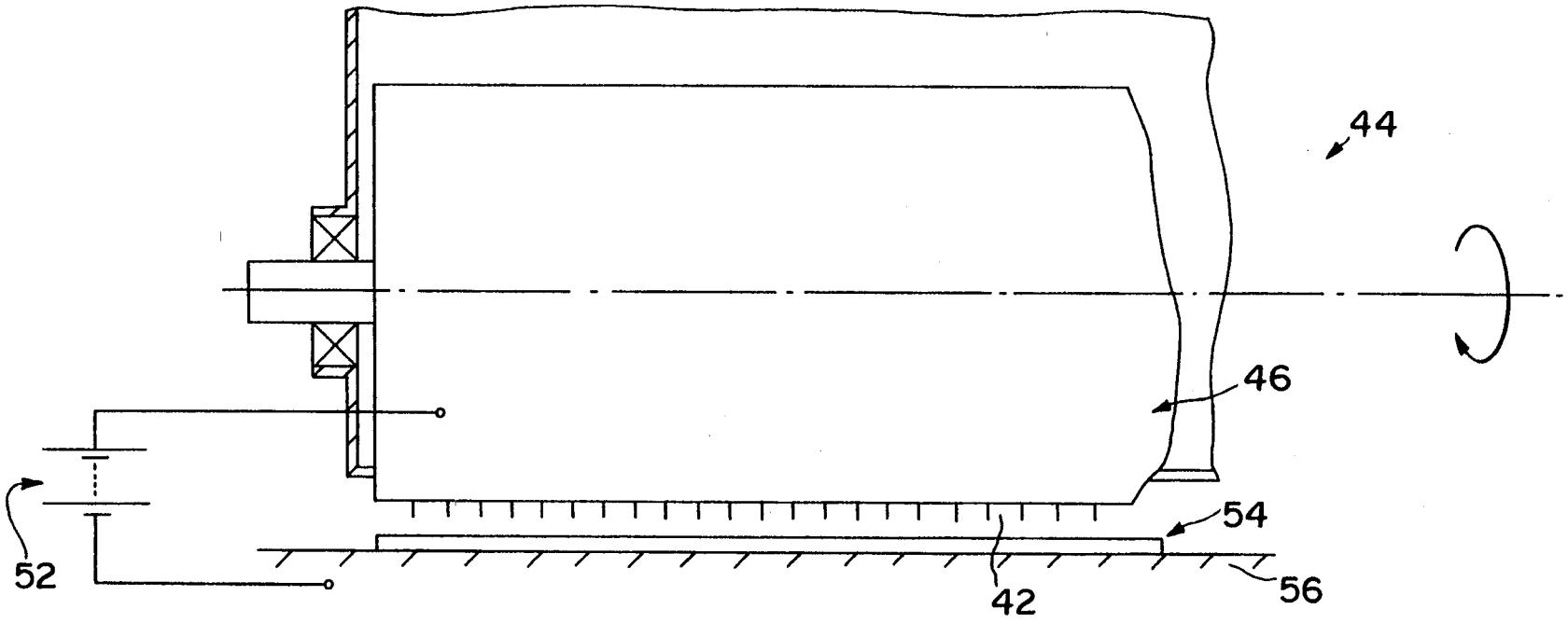
Figure 4:
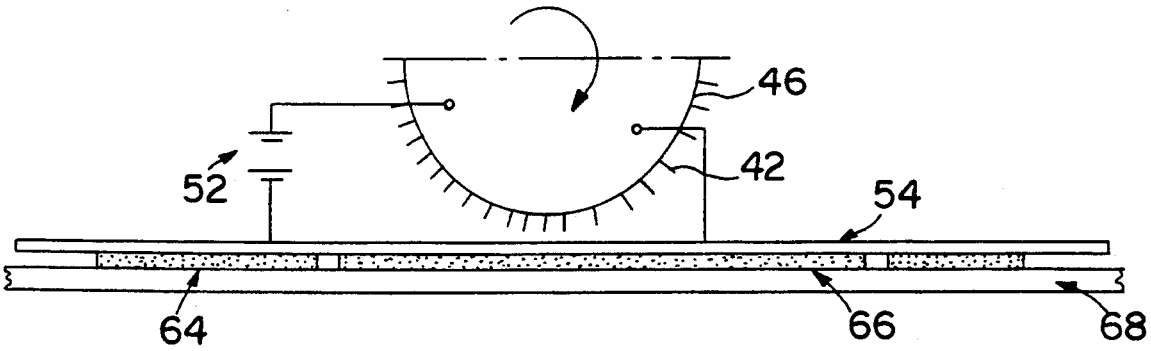
Figure 5:
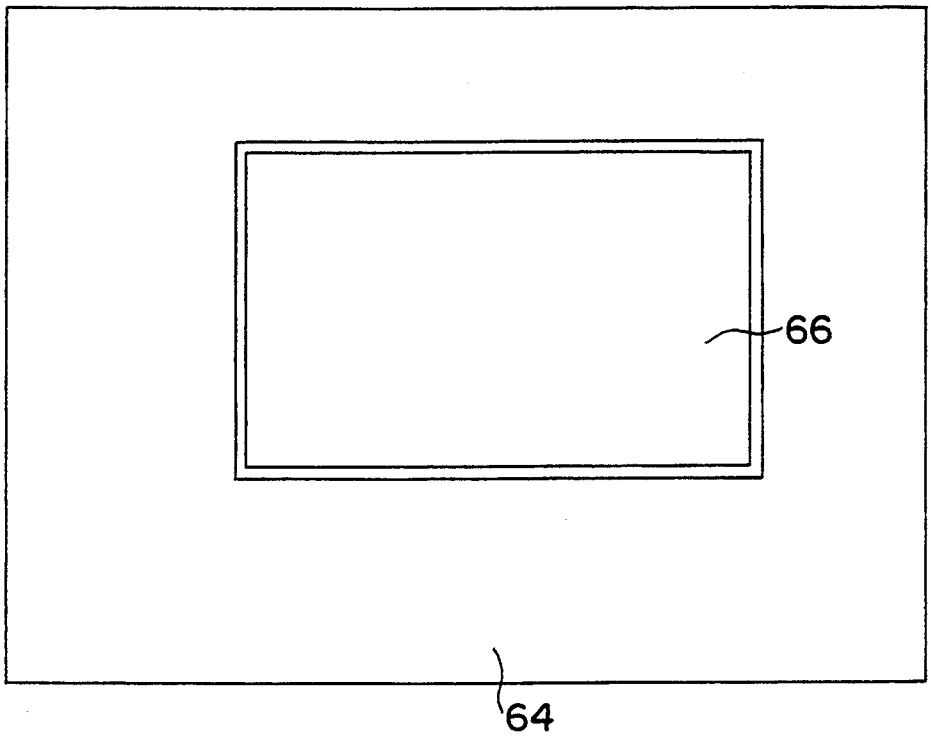
Figure 6:
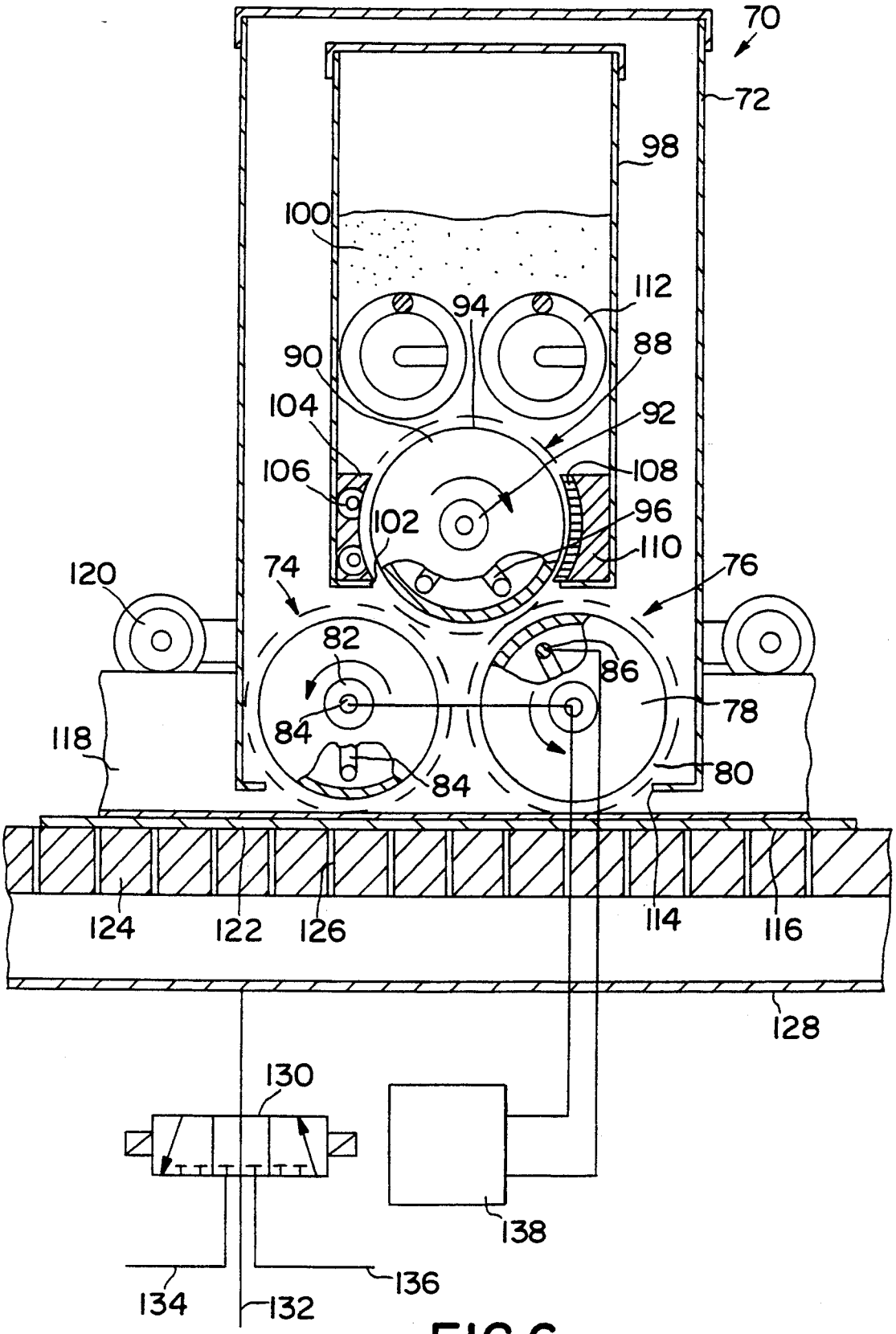
Figure 7:
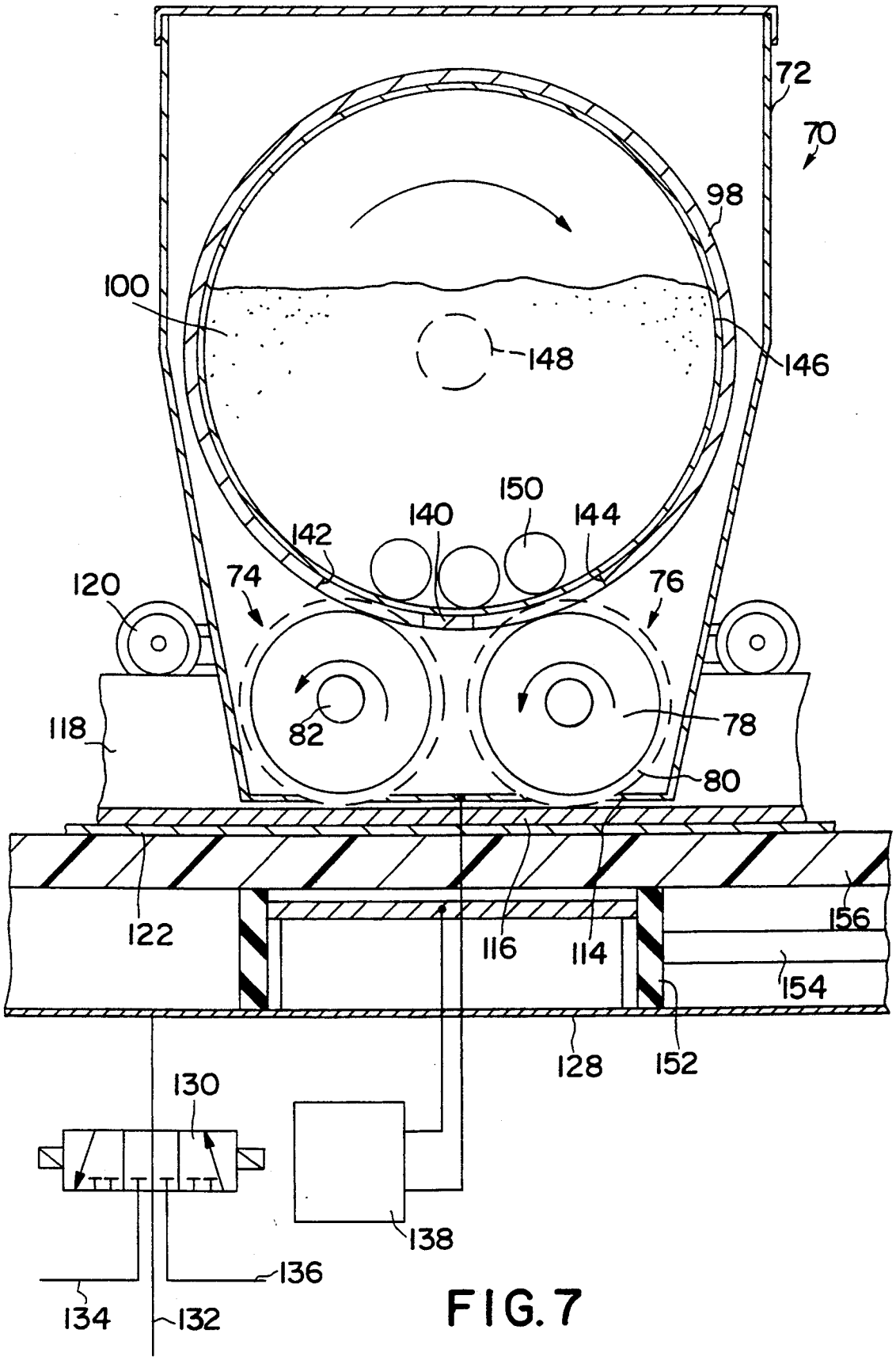

The invention is described in detail below with the aid of illustrative embodiments with reference to the drawings, in which:

FIG. 1: is a schematic view in perspective of a simple flat-screen dry screen printing unit;

FIG. 2: shows a schematic transverse section through a dry printing unit for the plane coating of a printing substrate;

FIG. 3: is a view onto the downstream end of the dry printing unit shown in FIG. 2;

FIG. 4: shows a schematic transverse section through a modified dry printing unit;

FIG. 5: is a view onto a lower electrode arrangement of the dry printing unit shown in FIG. 4;

FIG. 6: shows a transverse section through a modified dry screen printing unit; and FIG. 7: is a sectional view similar to FIG. 6 showing a dry screen printing unit which is again modified.

In FIG. 1, a dry screen printing unit in which screen and printing substrates are stationary during production of the image is designated 10 overall.

Reference numeral 12 denotes a stator or the primary part of a linear motor which serves at the same time as a support and bed and is carried by an apparatus frame not shown in detail. Provided over the stator 12 is an insulation layer 14 which may be omitted if the stator 12 itself already has an insulating surface. Arranged above the insulation layer 14 is an electrode 16 which may, for example, be made of aluminium. These components are thus all arranged in a stationary manner at the printing station.

A conveyor belt 18 of dielectric material runs above the electrode 16, which conveyor belt moves a printing substrate 20 through the dry screen printing unit 10 in the direction indicated by an arrow A. The conveyor belt 18 may also be omitted and replaced by a fixed printing substrate carrier which, however, can also be dispensed with. If the conveyor belt 18 is provided, it moves successive printing substrates 20 (or successive sections of a very long or endless printing substrate 20) in steps through the dry screen printing unit in the direction of the arrow A and into a position opposite a screen 22. The word "screen" is used herein as an abbreviation for a screen printing stencil which in known manner has permeable and impermeable regions as required to reproduce the particular pattern to be produced on the printing substrate 20.

The screen 22 is held at the edge by a frame 24 the upper face of which carries a panel-shaped wall 26. In the wall 26, narrow slots 28 are provided at both sides, which serve to introduce printing powder into the interior of the box formed by the parts 22 to 26 and designated 30 overall. The box is therefore substantially closed but can deliver printing powder downward through the screen 22 and receives printing powder from a reservoir through the slots 28. A volume of printing ink located beneath the slot 28 to the left in the drawing is designated 32.

The entire box 30 and hence also the screen 22 is movable perpendicular to the plane of advance of the printing substrates in the direction of the arrow B and can thus be brought into contact with and lifted away from the printing substrate 20.

The device for supplying the printing powder to the box 30 is not shown in the drawing. The supply lines are sealed with respect to the slots 28 so that a completely closed printing powder supply system is obtained overall.

The printing powder present in the printing powder volume 32 is a printing powder that can be electrically charged by friction as is known per se for use in electrophotography. The size of the printing powder particles is so selected that they are able to pass through the open meshes of the screen 22. Also incorporated into the printing powder, however, is a ferromagnetic component. For example, ferromagnetic particles can be admixed with a conventional non-magnetic printing powder; alternatively, the ferromagnetic component can be incorporated into the printing powder particles themselves. Instead or in addition, ferromagnetic carrier beads having a diameter sufficiently large for them to be unable to pass through the open meshes of the screen 22 can be arranged above the screen 22.

A d.c. high-voltage source 34 is connected by one terminal to the electrode 16 and by the other terminal to the box 30. In this manner, an electrostatic field is obtained in the direction perpendicular to the plane of the screen. Connected in parallel to the d.c. high-voltage source 34 is an a.c. high-voltage source 36. Like the drives, not shown in the drawing, for moving the conveyor belt 18 in the direction of the arrow A and for moving the box 30 in the direction of the arrow B, these two high-voltage sources are switched by a control unit, also not shown, of the dry screen printing unit.

The dry screen printing unit described above operates as follows:

A printing substrate 20 is brought by the conveyor belt 18 into the position shown. The box 30 is lowered in such a manner that the screen 22 comes into contact with the printing substrate 20. An elongate, linear or columnar volume of printing powder 32 is then introduced into the box 30 through the slot 28. At that point in time, but not before, the lower electrode 16 is then connected to the d.c. high-voltage source 34, and the stator 12 is excited in such a manner that it generates a magnetic field extending transversely from left to right in the drawing across the screen 22. In this manner the printing powder volume 32 is moved across the entire screen 22. The printing powder, which has been charged by frictional electricity on approaching the screen 22 and moving by magnetism through the screen 22, is drawn through the open mesh regions of the screen 22 towards the surface of the printing substrate 20 which has been charged to the opposite polarity by means of the lower electrode 16. When a printing powder image has been so produced, the screen 22 is lifted away from the printing substrate 20. Only then, and not before, is the electrode 16 actively discharged by switching on the a.c. high-voltage source 36. The printing substrate 20 can then be moved further after discharging, in order, if desired, to fix the printing powder image produced.

As explained, in the drawing, the supply wires for the stator 12 have been omitted, as have the wires for controlling the high-voltage sources 34, 36.

As has also been already explained, the movements of the various mechanical components (conveyor belt 18, box 30, printing powder supply etc., the switching of the power units for the stator 12 and the electrode and also other machine functions such as, for example, fixing of the image) are carried out automatically by an appropriate control unit.

As has also been explained above, the screen 22 which forms the open base of the box 30 preferably is not flooded with printing powder; rather, for each printing powder image to be produced only a relatively small excess of printing powder is placed on the upper side of the screen 22 where it is then moved magnetically across the screen 22.

The printing powder used may be black, white or of any desired colour. It is also possible to apply two or more different printing powders to the same printing substrate in successive dry screen printing steps according to the present invention. For that purpose, the printing substrate can be moved successively through several printing stations in which the corresponding screens are charged with the respective different printing powders. Instead, it is also possible to use a single printing station to which the different screens together with their associated different printing powders are passed in succession. Whichever arrangement is used, each screen with its printing powder supply represents a separate self-sufficient printing head in which only the type of printing powder specifically provided for it is normally used. This means that different printing powders are not supplied in succession to one and the same screen.

Reference has been made above to printing powders of the kind already known per se for electrophotography. That reference is made only by way of example and the invention is not limited thereto. With the invention, there can be used as printing powder any material in particle form that can be charged and drawn through a screen electrostatically and results in a satisfactory printing powder image on the printing substrate.

The present invention further provides a dry printing powder for use in electrophotographic printing, for example in electrostatic dry screen printing, in dry tampon printing and in electrophotography.

Dry printing powders contain a pigment or dye for producing a visible image, and a carrier material that can be softened (for example by one or more of the following quantities: heat, pressure, solvents) and serves as binder and permits the printing powder image produced initially to be fixed. Such powders are widely used, for example as toners in electrophotography. Hitherto it was standard and regarded as essential for the individual printing powder particles to be in each case a mixture of binder and pigment. These two components were mixed together with optional additives in the extrusion melt and the homogeneous mixture so obtained was ground to form particles.

Surprisingly, it has now been discovered that for electrostatic dry printing a simple dry mixture of binder particles with particles of an image-producing material (pigment or dye) can also be used successfully instead. Such a new printing powder according to the invention is especially suitable for electrostatic dry screen printing. It can also be used, however, in dry tampon printing or as an electrophotographic toner. The new printing powder obtained by dry mixing can be produced considerably more cheaply than can conventional printing powders for which considerable shut-down periods in an expensive-production plant have to be tolerated when it has to be cleaned between two charges in which different pigments are used. This is not necessary with the new printing powder according to the invention since it is possible to produce a homogenous basic binder powder continuously and only later mix it with any pigments or the like as the case requires. This dry mixing together of the particular printing powder required from basic binder particles and pigments may, where appropriate, be carried out by the printer or the copying establishment itself. This extends the palette of printing powders readily available to the printer.

The binder particles in the new printing powder according to the invention may be of the same size and the same material as the toner particles used for conventional electrophotography, for example may consist of (heat-, pressure- or solvent-) softenable plastics material, but without any toner pigment. The binder particles are normally neutral or colourless, for example transparent or white, although this is not essential for all applications.

Suitable plastics materials include a mixture of polystyrene with from 5 to 25% by weight polybutyl methacrylate and a mixture containing 25% by weight polyvinylbutyral and 70% by weight of a rosin-modified phenol formaldehyde resin. The binder particles may be heat-curable provided that they can be softened to fix the image. The binder particles may further comprise a surface-active substance or a metal soap (e.g. Zn stearate) as a dry lubricant. The printing powder according to the invention may correspond to that described for conventional electrophotographic toners on pages 69 ff. of the book "Electrophotography" by R. M. Schaffert, with the sole exception that the pigments are added as separate particles. Other conventional components may also be present in the printing powder according to the invention, such as those already known in the case of known toners and printing powders (e.g. dry lubricants), either as a component part of the binder particles and/or as separate particles. The pigments used in the printing powder according to the invention may also be conventional pigments as such, as used in known printing powders. In cases where the pigment is soluble in the binder or is transparent (dye) it is also possible to produce glazing images with the printing powder. Instead of conventional pigments or in addition thereto, textile dyes, glass or metal powders can also be used as image-producing materials.

Printing powders manufactured according to the present invention can also be used as (one-component or two-component) developers in electrophotography.

If printing powders according to the invention are used for electrostatic dry screen printing with magnetically assisted distribution of the printing powder, then either the binder particles may contain magnetic particles or particles of magnetic material may be admixed with them, for example ferrite material. Usually, however, this is suitable only when dark pigments are being used. In other cases, larger magnetic carrier beads that cannot pass through the screen can be used.

A further aspect of the present invention relates to an electrostatic powder coating process and to an apparatus for carrying out the same.

One example of a coating process that is of particular interest economically is the application of a layer of varnish to printing substrates such as sheets and webs of paper.

Varnishing of sheets and webs of paper is usually carried out using solvent-based varnishes. The giving-off of solvent to the atmosphere is disadvantageous, however, on environmental protection grounds. Because of the flammability of the solvents and the costs involved in recovering them, however, water-based varnishes have increasingly been introduced. The latter require large amounts of energy for drying. Recently, UV-curable varnishes have been introduced in order to eliminate the afore-mentioned difficulties. These too have certain disadvantages, however. Apart from their high cost, they require ionising radiation in the UV region of the spectrum for polymerisation. This radiation produces ozone which has to be carried away in pipelines. The UV-curable varnishes also constitute a health hazard for the skin of persons handling those varnishes. Often, these varnishes also have a smell which makes them unsuitable, for example, for the packaging of foodstuffs. All of the above-mentioned disadvantages are eliminated if a coating is produced by laminating with a film. Very good results are also obtained in this manner. However, the costs of laminating with a film are so high that only in extraordinary cases can this procedure be regarded as an alternative to the coating of a web.

In powder coating it is possible to produce varnish films, adhesive films or the like, but it is very difficult to apply small quantities of powder evenly to substrates moving at normal machine speeds (e.g. from 3 to 15 $g/m^2$ at speeds of up to 120 m/min) to produce a corresponding coating if conventional powder coating machines and conventional powders are used. The turbulence caused by the movement of the substrate always results in uneven coatings because the coating particles are blown around. Although this problem is reduced if the size of the particles is increased, an undesirable increase in the weight of the coating is obtained.

It has now been found that these difficulties can be eliminated with the process described below: The powder provided for the coating is produced in a small particle size (e.g. from 5 to 15 $\mu$m), and this powder is mixed with electromagnetic carrier particles. The powder mixture so obtained is applied electrostatically and placed on a substrate using a magnetic brush. At the same time, an electrostatic bias voltage is applied between the magnetic brush and the substrate, thereby attracting the charged powder particles to the surface of the substrate.

The process is described below with reference to the apparatus shown in FIGS. 2 and 3.

The coating powder may be, for example, a varnish powder of polystyrene-acrylic copolymer. A charge controlling agent and a flux controlling agent may be incorporated. This powder is mixed with magnetic carrier particles, for example ferrite material coated with a polymer material and having a particle size of from 75 to 150 $\mu$m, the weight ratio of the coating powder to the carrier particles being up to 6%.

Such a mixture of coating powder and carrier particles is designated 42 in FIG. 2. It is placed in a two-component developer unit 44 having a magnetic brush designated 46 overall. The latter includes a revolving brush shell 48 surrounding stationary permanent magnets 50. The brush shell 48 is connected to a d.c. high-voltage source 52 which delivers a voltage of, for example, 500 V and generates the bias voltage. A substrate 54 to be coated is carried by an electrode 56 which serves at the same time as a bed. The coating powder is triboelectrically charged by the magnetic brush 46. Provided on the developer unit 44 is a doctor blade 58 the free edge of which is at a set distance from the brush shell 48. This gap is designated 60 in the drawing. The magnetic brush is able to apply the coating powder to the substrates 54 very evenly and in precisely defined amounts. The weight of the finished coating depends to a large extent on the charge of the coating powder, the ratio between the speed of revolution of the magnetic brush and the speed at which the magnetic brush 46 is moved over the substrate 54, and on the ratio of coating powder to magnetic carrier particles. The developer unit 44 further has a scraper blade 62 which peels the carrier particles from the brush shell 48 after the coating powder has been applied to the substrate 54. Any carrier particles that should have come away from the brush shell 48 can be recovered from the surface of the substrate 54 by a magnetic bead scavenger.

Coating with powder depends on the potential difference set between the brush shell 48 of the magnetic brush 46 and the electrode 56 supporting the substrate 54. Such support by the electrode is required in the case of non-conductive substrates; in the case of electrically conductive substrates these can themselves serve as developer electrodes.

Melting of the varnish powder or adhesive powder can be effected in the conventional manner. For high-gloss varnish coatings a very smoothly polished chromed hot calendering roller can be used. In order to prevent sticking, a parting agent can be used, e.g. a silicone, which either is added to the varnish and/or is applied to the calendering roller.

With coatings, certain areas of the substrate should often remain uncoated, for example when an adhesive is to be additionally applied to a printing substrate after varnishing, since adhesive does not generally adhere well to varnish.

This is difficult in the case of conventional wet coating, and a further advantage of the electrostatic powder coating according to the present invention resides in the fact that it is easy to carry out coating of selected areas. One way of achieving such a coating of selected areas of a substrate will now be described with reference to FIGS. 4 and 5. When coating selected areas it is necessary to use a specially shaped electrode, as is shown at 64. This electrode again serves at the same time as a support for the substrate 54 to be coated. The electrode 64 is of opposite polarity to the polarity of the coating powder and extends over the areas to be coated. A further electrode 66 has the same polarity as the coating powder and extends over those areas which are not to be coated. The two electrodes 66 and 68 are arranged on an insulating plate 68.

The present invention further provides a new tampon printing process. In conventional tampon printing, the recesses of a printing block are first filled with printing ink (temporary image carrier), this printing ink is brought out of the printing block with the aid of a tampon (usually of silicone rubber) (printing ink intermediate image) and then transferred by the tampon to a printing substrate (product to be printed; final printing ink receiving surface).

Tampon printing is used especially when relatively small areas or irregularly shaped surfaces have to be printed. Applications are, for example: motor vehicle instruments, electrical goods, household objects, toys and advertising articles, scales of instruments, compact discs, packaging etc.).

The main disadvantages of tampon printing are the really high costs, the short life of the printing block and the fact that the printing inks used are usually flammable and harmful to the printer and the environment. Furthermore, the amount of printing ink that can be removed from the printing block by the tampon is very limited so that it is often necessary to overprint several times to obtain sufficient printing ink cover. The life of the tampon also is limited since residues of printing ink have to be removed from the tampon with solvents that corrode the surface of the tampon in the course of time, causing the print quality to suffer.

All of these difficulties can be avoided according to the invention by producing an unfixed image consisting of electroscopic dry toner on an intermediate carrier that does not have a great adhesive power for the printing powder, for example on paper, silicone-coated paper, plastics films such as PTFE, polyester, PVC or the like. Other very smooth and even surfaces having poor adhesive power for the printing powder, such as metal or glass, are also suitable. The tampon (usually of silicone rubber) is then used to transfer the printing powder image to the final substrate where the printing powder is then fixed. To do this, the substrate to be finally printed can be heated to the melting temperature of the toner, preferably before or simultaneously with the transfer of the printing powder image, so that the printing powder image is transferred and fixed in one step. The physical properties of the substrate to be finally printed can also be optionally so selected that it exhibits adhesive properties for the printing powder image.

The toner preferably has exactly the opposite polarity to that of the tampon and the substrate to be finally printed.

The unfixed printing powder image can be produced or printed in various ways, for example by dry screen printing. Another convenient and advantageous method of producing an unfixed printing powder image is that performed on an electrophotographic image converter or copier, the unfixed toner image being taken from the photoconductor by the tampon, which preferably has the opposite polarity to that of the toner, and transferred to the surface to be finally printed which is again preferably heated to the melting temperature of the toner. The electrophotographic machine must be capable of producing an unfixed (e.g. not yet melted) image and can be interlinked with the tampon printing machine in such a manner that the correct print register is assured. For this purpose, there is preferably used an endless conveyor belt having a low adhesive power for the toner, which carries the toner image away from the photoconductor. The unfixed toner image is then transferred from the conveyor belt having low powder adhesion power to the surface to be finally printed, using the tampon. Alternatively, the developed toner image can also be transferred directly from the photoconductor to the tampon, which preferably has an opposite charge to the charge of the toner, and the tampon then places the toner image on the surface to be finally printed which has preferably been heated to the melting temperature of the toner. In that case, the lens of the electrophotographic machine, for example a photocopier, must be so designed that a right-reading image is obtained on the photoconductor. The photoconductive layer can alternatively be provided on a paper substrate as is available commercially under the trade name "Electrofax".

Another advantage obtained by using an electrophotographic system in dry tampon printing is that printing can begin immediately, as soon as an original has been placed in the machine. This eliminates the time delay and eliminates the costs arising from the production of a printing block.

In another tampon printing method, a thermoplastic screen printing ink is printed onto a temporary carrier having only a low adhesive power, for example silicone-coated paper, silicone rubber or a PTFE film, and the printed image is transferred with a silicone rubber tampon to the surface to be finally printed. This method is especially useful when the article to be printed is heat-sensitive and melting of the printing ink by the effect of heat cannot be used.

Another modified tampon printing method, which has proved useful especially in the case of heat-sensitive substrates, comprises using a (UV) radiation-curable printing ink to which a small amount of a volatile solvent (e.g. 5% ethyl acetate) has been added. It is thus possible to use radiation-curable printing inks in conventional tampon printing machines without having to modify the latter. After the printing ink has been transferred from the printing block to the final printing substrate, the printing ink is cured by irradiation with UV or electron radiation.

FIG. 6 shows a vertical longitudinal mid-section through an inking head, designated 70 overall, of a screen printing machine and the adjacent parts of the machine during printing.

Mounted in an outer housing 72 are two brush rollers 74, 76 each having a roller core 78 of fibre-reinforced plastics material and, arranged thereon, a fibre pile 80 of dielectric or highly resistive conductive flexible fibres. Such fibres are, for example, fine polyamide or carbon fibres. The fibre pile 80 yields softly.

Firmly mounted at both ends of the roller cores 78, for example integrally moulded thereon, are stub shafts 82 which likewise consist of insulating material. The stub shafts 82 each have a central bore through which there extends a bearing portion of a cranked lower transfer electrode 84. The end thereof lying behind the plane of the drawing in FIG. 6 is carried freely by the bearing portion of the transfer electrode 84. The paraxial portion of the transfer electrode 84 extends in the vicinity of the lowermost generating line of the roller core.

Each of the roller cores 78 further contains an upper transfer electrode 86 the bearing portion of which is similarly passed through the rear stub shaft, not shown in the drawing, of the roller core 78 and the paraxial electrode portion of which is approximately in the 11 o'clock position or the 1 o'clock position and accordingly points towards a roller nip formed by the brush rollers 74 and 76 together with a metering roller 88.

The metering roller 88 has a roller core 90 likewise made of fibre-reinforced insulating plastics material, with stub shafts 92 mounted at both ends, and carries a fibre pile 94 which consists of relatively short and stiff fibres (resembling velvet).

Carried by the stub shafts 92, again made of insulating material, of the roller core 90 is a further, forked transfer electrode 96 having two paraxial electrode portions in the 5 o'clock position and the 7 o'clock position which accordingly lie opposite the transfer electrodes 86.

The metering roller 88 rotates in a reservoir 98 in which there is a supply 100 of printing powder. The base of the reservoir 98 has a window 102 through which the metering roller 88 projects so that it is able to engage with the two brush rollers 74, 76. A dynamic seal between the metering roller 88 and the reservoir 98 is obtained upon entry through a brake-block-like bearing part 104 which surrounds the metering roller 88 at a distance and carries two sealing rollers 106. The latter are preferably set in rotation by a drive, not shown in FIG. 6, in such a manner that they roll on the circumferential surface of the metering roller 88 without slipping. At the outlet side, sealing between the metering roller 88 and the reservoir 98 is accomplished by a velvet-like fibre pile 108 which is carried by a further brake-shoe-like element 110. In this manner, printing powder carried back by the metering roller 88 is prevented from being scraped off upon entry into the reservoir 98, while the fibre pile 108 on the one hand limits the amount of printing powder entrained by the metering roller 88, distributes the entrained printing powder well and, furthermore, also causes the printing powder particles to be charged by intense friction.

Two agitating coils 112 provided above the metering roller 94 in the reservoir 98 keep the supply of printing powder in a flowable state and prevent a bridge from being formed in the supply of printing powder.

As can be seen from FIG. 6, the brush rollers 74, 76 are spaced apart and rotate in the same direction as each other. The metering roller 88 rotates in the opposite direction so that parallel-oriented circumferential speeds of the engaged pairs of rollers are obtained at the two roller nips.

The base wall of the outer housing 72 has a window 114 through which the lowermost portions of the brush rollers 74, 76 project. These portions are in gentle sliding engagement with the upper side of a screen 116 which is held by a frame 118 and has permeable and non-permeable portions corresponding to the printing pattern to be produced. In the embodiment shown, the longitudinal bars of the frame 118 serve at the same time as rails on which spur wheels 120 fastened to the outer housing 72 run.

The screen 116 is in direct contact with the upper side of a printing substrate 122, for example a sheet of paper, which is placed on an electrode 124. The latter has a plurality of small bores 126 which communicate with the interior of a distributing box 128. The latter is selectively connectable to a venting line 132, a vacuum line 134 or with an excess pressure line 136 by means of a 4/3 solenoid valve 130.

A d.c. high-voltage source 138 typically providing a voltage of from 2 to 6 kV at its output terminals is connected by its one output terminal to the electrode 124 and the transfer electrodes 86, and by its other output terminal to the transfer electrodes 84 and the forked transfer electrode 96. Thus, wherever the powder particles are transferred there is an electrostatic field which assists in the transfer. Depending on how the printing powder is charged, a high-voltage source that provides a positive or negative output voltage at the terminal connected to the base electrode 124 is selected.

The screen printing machine shown in FIG. 6 operates as follows:

With the distributing box 128 under excess pressure, the printing substrate 122 is pushed onto the electrode 124. As soon as it has reached the correct position relative to the screen 116, a vacuum is applied to the distributing box 128, thus fixing the printing substrate 122. The screen 116 is then lowered so that it rests on the upper side of the printing substrate 122. The high-voltage source 138 is then switched on and, as the metering roller 88 and the brush rollers 74, 76 rotate, the printing powder carried out by the fibre pile 94 is passed to the fibre piles 80. With a view to making the powder distribution more even and with a view to increasing the charge of the printing powder particles on the one hand and with a view to limiting the speed at which the metering roller 88 moves through the printing powder supply 100, the brush rollers 74, 76 can also be run at a higher circumferential speed than that of the metering roller 88. Transfer of the printing powder particles is assisted by the field which is formed between the transfer electrodes 86 and 96.

The printing powder particles carried by the brush rollers 74, 76 are moved through the free regions of the screen 116 partly mechanically and partly by the field generated by the transfer electrodes 84 together with the base electrode 124, and adhere to the surface of the printing substrate 122.

The entire inking head 70 is moved from left to right in FIG. 6, over the screen 116 and the printing substrate 122, the circumferential speed of the brush rollers 74, 76 being set to three to four times the speed of advance of the inking head 70.

In order that the inking head 70 inks all of the regions of the screen 116 with the same intensity, the screen 116 has at the left- and right-hand ends in FIG. 6 a broad edge region which corresponds to the overall width of the inking head 70, so that the latter can be moved away from the active image region of the screen "seamlessly" in both directions.

When the screen has been completely inked, the inking head 70 is raised and the screen 116 is first tilted away from the printing substrate about an axis adjacent to its side edges and only then is it moved away perpendicular to the plane of the printing substrate. This prevents printing powder from falling off due to sudden "jumping" of the screen.

After the screen 116 has been moved away in that manner, the distributing box 128 is again placed under excess pressure so that grippers, not shown, can move the printing substrate to a fixing station, not shown in the drawing, without the static friction being broken up and without the printing powder pattern being smeared due to inertia.

In the embodiment shown in FIG. 7 parts of the dry screen printing machine that correspond to parts already discussed with reference to FIG. 6 are again provided with the same reference numerals. These machine parts do not need to be described again in detail below.

The reservoir 98 is cylindrical and has two windows 142, 144, separated by a partition 140, through which the brush rollers 74, 76 penetrate and are in contact with a screen cylinder 146 cooperating with the inner surface of the reservoir 98 with a close sliding fit. The screen cylinder 146 is mounted on the reservoir 98 by stub shafts 148 and contains the supply 100 of printing powder. In addition, balls 150 which thoroughly agitate the printing powder supply 100 and keep it in a flowable state are placed in the screen cylinder 146.

The electrode 124 is carried by a carriage 152 made of insulating material which is advanced by a rod 154 synchronously with the inking head 70 so that the electrode 124 is always beneath the brush rollers 74, 76. The distributing box 128 is closed at the top by an open-pored or finely perforated insulating plastics plate 156 which forms the bed for the printing substrate 122.

The high-voltage source 138 is connected by its one terminal to earth and to the inking head 70 in which the roller cores 78 are made of electrically conductive material and do not contain any transfer electrodes since the latter are in this case formed by the roller core. The other terminal of the high-voltage source 138 which, depending on the printing powder, is positively or negatively grounded, is connected to the electrode 124. By means of the described arranged there is obtained in a simple manner an all-round insulation of the unearthed electrode of the dry screen printing machine.

Modifications of the embodiments described above may comprise:

- imparting an axially reciprocating motion to the metering roller and/or the brushes to distribute the printing powder even more evenly,
- charging the brush exterior before printing powder is taken from the reservoir, for example by a corona discharge,
- charging the surface of the printing substrate to be printed before applying the screen, for example by a corona discharge,
- moving the inking head across the screen repeatedly, selecting polyester resin or epoxy polyester resin as binder,
- selecting polyamide or PTFE or carbon fibres for the fibre pile,
- using brush rollers having tufts of fine flexible and soft bristles, for example polyamide, acrylic, PTFE or carbon fibres, set into the roller core,
- using fibre mixtures, for example electrically conductive and dielectric fibres instead of a single kind of fibre,
- switching on the electric field even before the screen printing stencil has been applied to the printing substrate (soft graphics effect),
- switching off the electric field even before the screen is removed from the printing substrate (flatter image, smaller quantity applied).

Where voltage values for producing the electric transfer field have been specified above, they apply to brush diameters of about 6 cm combined with the brush axis as the upper electrode, that is to say to an electrode spacing of about 3 cm.

Wherever a fibre pile is mentioned above and in the claims, it is to be understood as being a flat formation of closely adjacent soft fibres having a length of from 5 to 10 mm. Such piles are obtainable commercially in the form of velvet-like fabrics.

If brush rollers equipped with bristles are used (preferably for the brush rollers 46, 74, 76), the bristle length is from 10 to 40 mm.

Wherever fibres are mentioned above and in the claims they are to be understood as being any linear flexible structure unless explicitly defined otherwise. This structure does not need to be in one piece in the mechanical sense but may also be formed, for example, by a linear series-arrangement of magnetic particles in a magnetic field or of electrically charged particles or dipolar or polarised dielectric particles in an electric field.

I claim:

1. A dry printing process comprising the steps of (a) arranging a printing substrate to be printed on a bed and positioning a screen printing stencil over said printing substrate in direct contact therewith, (b) dusting at least one brush having flexible fibres with a dielectric printing powder particles containing a dielectric plastics binder and pigments, (c) moving said at least one brush over said stencil and said printing substrate under the simultaneous effect of an electric field, the field lines of which extend substantially perpendicular to the surface of said printing substrate;

(d) fixing said printing powder on said printing substrate, (e) maintaining an electric field of at least 100 V/cm in the vicinity of the portion of said printing substrate that is positioned opposite said at least one brush;

(f) said moving of said at least one brush is done while maintaining a close working distance between the outer surface of said at least one brush and said printing substrate, (g) the average diameter of said printing powder particles being greater than about 5 μm and not greater than 15 μm, the diameter of the printing powder particles being selected to be smaller than the mesh width of said screen printing stencil, and (h) removing said screen printing stencil from said substrate.

2. Process according to claim 1, wherein the average diameter of said printing powder particles is from about 5 to about 8 μm.

3. Process according to claim 1, wherein at least a first portion of step (d) is effected by tilting said stencil about a tilting axis which is adjacent to a lateral edge thereof.

4. Process according to claim 1, wherein said electric field is switched on after said screen printing stencil has been placed on said printing substrate.

5. Process according to claim 1, wherein said electric field is switched off after said screen printing stencil has been lifted away from said printing substrate.

6. Process according to claim 1, wherein said flexible fibres are composed of dielectric material.

7. Process according to claim 1, wherein said fibres of said at least one brush are formed by magnetizable particles which have arranged themselves along field lines of a magnet arrangement forming part of said at least one brush.

8. Process according to claim 7, wherein the diameter of the magnetizable particles is greater than the mesh width of said screen printing stencil.

9. Process according to claim 7, wherein said magnetizable particles are incorporated in said printing powder particles.

10. Process according to claim 7, wherein said magnet arrangement is a permanent magnet arrangement.

11. Process according to claim 7, wherein said magnet arrangement is a travelling wave magnet arrangement.

12. Process according to claim 1, wherein each brush is a rotating brush roller and the tangential speed thereof is about three to four times greater than the speed of the translational movement occurring between said printing substrate and axis of each said brush roller.

13. Process according to claim 1, wherein said electric field is from 0.3 to 10 kV/cm.

14. Process according to claim 1, wherein a dielectric intermediate layer is placed between said printing substrate and a lower electrode.

15. Process according to claim 1, wherein an electrically conductive plastics layer is used as a lower electrode in said electric field.

16. Process according to claim 15, wherein said plastics layer is resiliently deformable.

17. Process according to claim 1, wherein said printing powder particles on each brush are electrically charged.

18. Process according to claim 2, wherein the surface of said screen printing stencil consists of electrically conductive material.

19. Process according to claim 18, wherein said screen printing stencil is suspended in an isolated manner and has a floating potential.

20. Process according to claim 1, wherein said printing substrate is an intermediate carrier for said printing powder particles and the image produced on said intermediate carrier is transferred to a final printing substrate by mechanical contact and is fixed there, said intermediate carrier being so selected that said printing powder particles adhere to it less well than they do to said final printing substrate.

21. Apparatus for carrying a dry printing process comprising (a) a bed (18; 56; 64; 124; 156) for a printing substrate (20; 54; 122) that is to be printed;

(b) a screen printing stencil mounted above said printing substrate and in direct contact therewith, (c) at least one brush (32; 46; 74, 76) with flexible fibres and means for dusting each brush with a printing powder containing a dielectric plastics binder and pigments;

(d) a means for moving each brush over said stencil and said printing substrate and comprising a field generator (16, 26, 34, 36; 48, 52, 56; 84, 124, 138; 72, 124, 138) which generates an electric field in the vicinity of the portion of said printing substrate (20; 54; 122) lying opposite each brush, the field lines of which extend substantially perpendicular to the surface of said printing substrate; and (e) means for fixing said printing powder on said printing substrate;

(f) said field generator being capable of generating a field of at least 100 V/cm in the vicinity of the portion of said printing substrate that is opposite said at least one brush;

(g) means (18; 118, 120) for moving each brush and maintaining a small working distance between the outer surfaces of each brush and said printing substrate; and (h) said at least one brush being arranged in a box (30; 72) which is open towards said stencil and said printing substrate and cooperating with said stencil and said printing substrate in a substantially sealed manner.

22. Apparatus according to claim 21, wherein an upper wall of said box (30; 72) has at least one narrow opening (28) for re-filling with printing powder.

23. Apparatus according to claim 21, wherein said at least one brush has a rotating brush shell made of dielectric material which carries a dielectric fibre pile (80).

24. Apparatus according to claim 23, wherein each said brush has an internal electrode (84; 86) which is offset from a roller nip defined by the respective brush and said stencil.

25. Apparatus according to claim 21, wherein each brush has a rotating conductive roller core carrying a conductive, highly resistive conductive fibre pile which thus forms an upper electrode and a lower electrode is arranged over said bed.

26. Apparatus according to claim 21, which includes means for electrically charging the outer surface of each brush.

27. Apparatus according to claim 21, wherein each brush comprises a magnet containing brush core and fibres formed by magnetic particles and a doctor blade (58) which cooperate with an outer surface of an associated brush and which are arranged upstream of a working opening of said box (44) viewed in the direction of rotation of the associated brush.

28. Apparatus according to claim 27, wherein a scraper is arranged in said box (44) opposite said working opening and cooperates with the outer surface of an opposing rush core (48).

29. Apparatus according to claim 28, wherein said scraper blade (62) falls obliquely away from the outer surface of said brush core (48) and the end thereof remote from the brush ends at a spaced distance from a wall of said box.

30. Apparatus according to claim 21, which includes means for axially reciprocating each brush.

31. Apparatus according to claim 21, which includes a metering roller (88; 146) which runs in a substantially sealed manner in a delivery opening of a printing powder reservoir (98) and is in contact with the outer surfaces of each brush (46; 74, 76).

32. Apparatus according to claim 31, wherein said metering roller (88) has a roller core (90) and a fibre pile (94) carried by said roller core.

33. Apparatus according to claim 32, which includes means for axially reciprocating said metering roller (88; 146).

34. Apparatus according to claim 31, wherein said reservoir is grounded and there is an insulating space between it and said at least one brush.

35. A process according to claim 1 wherein after application of the printing powder, the printing substrate is lifted away from the bed supporting it by an excess-pressure air cushion and is moved to another location where fixing of the printing powder takes place.

* * * * *